US006965862B2

(12) United States Patent
Schuller

(10) Patent No.: US 6,965,862 B2
(45) Date of Patent: Nov. 15, 2005

(54) READING MACHINE

(76) Inventor: Carroll King Schuller, 254 Steeplechase Ct., Deptford, NJ (US) 08096

( * ) Notice: Subject to any disclaimer, the term of this patent is extended or adjusted under 35 U.S.C. 154(b) by 0 days.

(21) Appl. No.: 10/120,711

(22) Filed: Apr. 11, 2002

(65) Prior Publication Data

US 2003/0195749 A1 Oct. 16, 2003

(51) Int. Cl.[7] ..... G10L 13/00

(52) U.S. Cl. ..... 704/258; 704/260; 382/313; 382/314; 382/317; 382/319; 358/473; 358/474

(58) Field of Search ..... 382/313–319; 358/473–474, 358/487, 448, 483, 475; 704/260, 258; 235/472, 235/462; 250/566, 221

(56) References Cited

U.S. PATENT DOCUMENTS

| | | | | |
|---|---|---|---|---|
| 4,847,484 A | * | 7/1989 | Kikuchi | 250/221 |
| 5,218,457 A | * | 6/1993 | Burkhardt et al. | 358/448 |
| 5,381,020 A | * | 1/1995 | Kochis et al. | 250/566 |
| 5,410,141 A | | 4/1995 | Koenck et al. | 235/472 |
| 5,430,558 A | | 7/1995 | Sohaei et al. | 358/473 |
| 5,514,861 A | | 5/1996 | Swartz et al. | 235/472 |
| 5,574,804 A | | 11/1996 | Olschafskie et al. | 382/313 |
| 5,698,834 A | | 12/1997 | Worthington et al. | 235/472 |
| 5,744,788 A | | 4/1998 | Metlitsky et al. | 235/454 |
| 5,758,081 A | | 5/1998 | Aytac | 395/200.41 |
| 5,844,697 A | * | 12/1998 | Omvik et al. | 358/487 |
| 5,892,971 A | | 4/1999 | Danielson et al. | 395/827 |
| 5,917,174 A | | 6/1999 | Moore et al. | 235/462.44 |
| 5,920,877 A | | 7/1999 | Kolster | 707/512 |
| 5,936,528 A | | 8/1999 | Kobayashi et al. | 340/572.5 |
| 5,971,279 A | | 10/1999 | Raistrick et al. | 235/472.01 |
| 5,999,666 A | | 12/1999 | Gobeli et al. | 382/313 |
| 6,138,915 A | * | 10/2000 | Danielson et al. | 235/472.02 |
| 6,201,903 B1 | | 3/2001 | Wolff et al. | 382/317 |
| 6,208,435 B1 | | 3/2001 | Zwolinski | 358/473 |
| 6,218,964 B1 | | 4/2001 | Ellis | 340/990 |
| 6,292,595 B1 | * | 9/2001 | Petteruti et al. | 382/313 |
| 6,606,171 B1 | * | 8/2003 | Renk et al. | 358/475 |
| 2002/0029146 A1 | * | 3/2002 | Nir | 704/260 |
| 2002/0135815 A1 | * | 9/2002 | Finn | 358/473 |
| 2002/0158129 A1 | * | 10/2002 | Hu | 235/462.11 |
| 2002/0181805 A1 | * | 12/2002 | Loeb et al. | 382/317 |

OTHER PUBLICATIONS

"L&H™ Magnireader™We Change Lives", Available at http://www.lhsl.com, Nov. 2001. "Introduction-Reading Machines". Available at http://www.readsmart.com, Nov. 2001.

"Galileo Reading System". Available at http://www/readsmart.com, Nov. 201.

"Anatomy of a Charge-Coupled Device". Available at http://www.micro.magnet.fsu.edu, Feb. 6, 2002.

"Products and Software". Available at http://www.quicktionary.com, May 24, 2001.

(Continued)

*Primary Examiner*—Richemond Dorvil
*Assistant Examiner*—Qh Han
(74) *Attorney, Agent, or Firm*—Ernest D. Buff & Associates; Ernest D. Buff; Gordon E. Fish

(57) ABSTRACT

A portable reading machine has a scanner for scanning an image comprising text. The scanner has a scanning area occupying a maximum width and an active width defined by a scanning width limiting mechanism adjustable to a preselected width. A photoreceptive element forms an electronic representation of a portion of the image within the active width. The electronic representation is converted to a digital character string corresponding to the active image text. A speech system outputs the digital character string as ordinary spoken language voiced through a speaker or headset.

17 Claims, 6 Drawing Sheets

OTHER PUBLICATIONS

"Question of the Day". Available at http://www.howstuff-works.com, Feb. 6, 2002.
"Quick Link Pen". Available at http://www.learning-tools.net, May 24, 2001.
"QuickPad". Available at http://www.learning-tools.net, May 24, 2001.
Tyson, J. "How Flash Memory Works". HowStuffWorks. Available at http://www.howstuffworks.com, Feb. 6, 2002.

* cited by examiner

READING MACHINE

BACKGROUND OF THE INVENTION

1. Field of the Invention

This invention relates to the field of reading machines, and more particularly to a fully portable scanner that enables users to easily scan a block or column of text and hear the text recited audibly.

2. Description of the Prior Art

In recent years, the advance of electronics and computer technology has enabled the development of a number of devices that assist with ordinary tasks that entail reading and assimilating information in printed form.

Much of the development activity has centered on bar code scanning technology. Bar coding is a process for encoding information in a printed, graphic form. Typically a bar code is provided as a pattern printed in a specially appointed area on a paper or on packaging containing an item of manufacture or commerce. The pattern comprises a series of parallel printed lines of substantially equal length alternating with areas left unprinted. Various alternatives to traditional printing, including embossing, painting, screen-printing, and the like may also be used to form the pattern. The relationship of width and spacing of the printed lines, and the unprinted areas therebetween, encodes information. In the retail environment, individually packaged items offered for sale are now commonly imprinted with a standardized bar code, sometimes called a UPC code, which indicates the contents of a package. A cashier is equipped with a cash register that includes a reader adapted to optically scan the bar code for each item being purchased. Means are provided for ascertaining from a database the retail price of each item, accumulating a list of the items purchased, and providing the customer with a printed document itemizing the goods purchased and the total cost thereof. The cash register may also transmit to a remote computer an enumeration of the items sold for inventory tracking and control purposes.

Bar code systems are widely used in industry as a means of reliably tracking inventory and the flow of items in a manufacturing, warehouse, transportation, or retail environment. Items appointed for control frequently have a bar code imprinted directly thereon or carried by an auxiliary tag present either on the item itself or on its packaging. A pre-assigned bar code is used to identify a given item. Each item may be given a unique code; or items belonging to a common class may share a common code. Readers or scanners in various forms may be used to carry out inventory or article flow tasks commonly required in the course of business. Use of bar coding has a number of advantages, including improved reliability, since the possibility of human error in data entry is virtually eliminated.

The widespread use of bar code systems has been facilitated by the availability of reliable and cost-effective readers. The task of scanning bar codes is greatly simplified by the predictable and inherently simple, binary-like form in which they are presented for interrogation. In a given environment the bar code is printed according to a predefined format and size and is typically located in a standardized position. Thus the lines in a bar code are of predictable size and shape and appear in a fixed geometrical pattern relative to each other.

The simplicity of bar codes enables a relatively simple reader or scanner to be able to acquire an image optically and to convert it reliably into a corresponding electrical signal. Generally stated, a bar code reader comprises a light source, often a small laser source, that impinges a light beam onto an area of a surface on which the bar code is present and a photo detector or similar means of detecting the intensity of light reflected from the area into the reader. A simple linear scan traversing the bar code and sensing the variation in reflectivity along the line is sufficient to acquire all the information conveyed by the bar code. Simple forms of bar code readers rely on a user to manually scan the reader across the bar code. More sophisticated forms of reader further comprise an optical system using a moving mirror to automatically scan the light beam across an area of interest.

Scanning operations intended to acquire arbitrary textual and graphic information present a much more formidable challenge than do simple bar codes scanning operations. Printed items encountered in everyday life incorporate a very disparate variety of text fonts, sizes, spacings, and alignments. Moreover, the nuances differentiating certain letter pairs of the Roman alphabet are very slight. In addition, the simple, one-dimensional, linear scan that suffices for bar code reading is not adequate. Instead, the scan must acquire information over a two-dimensional area.

Tools have also been proposed to assist those whose ability to read is impaired by visual or perceptual difficulties. For example, tabletop scanners are available which may be connected to a personal computer (PC). A book or other printed matter may be positioned atop the scanner. The page presented may be scanned in its entirety. The resulting image is fed to the PC, where it is converted to a machine-readable text file through use of optical character recognition (OCR) software. The PC may further be interfaced with speech synthesis system to read out that text file. However, such systems have a number of limitations. They are large in size, have a fixed window of imaging area, and must be accommodated on a table or desktop. They require a source of ordinary household electrical current. Together these factors make existing systems impractical for portable use. Moreover, these systems lack simple means for the user to define a particular selection or subset of a larger text being presented. The challenge is particularly severe in dealing with printed material presented in a complex layout, such as a newspaper, in which text is organized in columns and a given story may span multiple columns having different lengths. Existing systems must rely either on further user intervention or contextual software processing after an image has already been acquired or pre-scanned to accomplish the limiting function. The multiple steps necessitated by either approach entail significant difficulties. The time required for the complete task of presenting, scanning, selecting, and processing a text increases. Highly sophisticated software is required, so a powerful and expensive computer processing facility is needed. The user must cope with a system, which lacks convenience and ease of use. While these systems have clearly benefited persons who are blind or face significant visual impairment, it would be highly desirable to have systems that are simpler to construct and use, less bulky and unwieldy so they can be made portable for a wider range of uses. Such systems would also benefit users having perceptual or learning disabilities that impair reading and comprehension of printed materials in a variety of contexts.

SUMMARY OF THE INVENTION

The present invention provides a method and apparatus that enables a user to readily scan a block or column of text and hear the text recited audibly via a voice module, or through a headset connection adapted for wired or wireless transmission. The scanned information can comprise multiple lines, selected segments of text such as columns or blocks, or substantially the entire textual content of a page. Scanned textual information may be processed by optical character recognition (hereinafter, "OCR") means to form an electronic representation of the text for further processing, voicing, storage, or transmission to an auxiliary personal computer (hereinafter, "PC") or a hand-held personal organizer (hereinafter, "PDA"). Retention of scanned text can comprise up to thirty pages or more. Links with a personal computer are optionally provided for upload or download of scanned information. Also contemplated are links permitting download of scanned information to a tape player. An optional transparent sleeve enshrouds the device to protect against damage from contaminants such as dust, oil, debris and the like. The screen may be transparent or segmented to permit review of portions of text other than those being scanned and transmitted verbally, or to permit note taking while listening to verbally read sections of text.

Advantageously, the reading machine of the invention comprises a scanner for scanning an image presented thereto and comprising text. The scanner has a scanning area with a maximum width and an active width defined by a scanning width limiting mechanism. The mechanism is adjustable to a preselected width at most equal to the maximum width. The scanner further comprises a photoreceptive element adapted to form an electronic representation of that portion of the image presented that is within the active width of the scanning area. The reading machine further comprises a converter connected to the scanner, the converter being adapted to receive the electronic representation from the scanner and to convert it to a digital character string corresponding to the text comprised in the portion of the scanned image that is within the active scanning width and area. The reading machine also includes a speech system that outputs the digital character string as ordinary spoken language voiced through a sound-producing element such as a speaker or headset, the element being connected via either a wired or a wireless connection. The output of the speech system may also be connected to a tape recorder or other comparable sound recording system.

The reading machine further includes a mechanism for limiting the response to material presented within an active scanning width that is at most as wide as the maximum scanning width which, in turn, is determined by considerations including the width of the photoreceptive element used for optically inputting the material appointed for scanning.

The scan width limitation capability advantageously increases alignment accuracy and minimizes or virtually eliminates the need for further processing of extraneous text, graphics, or other material prior to conversion of the scanned image into intelligible speech. This, in turn, accelerates scanning and improves scanning accuracy, causing the present reading machine to accomplish the scanning function in an efficient, reliable manner.

In different aspects of the invention, the scanning width limiting mechanism is operated either mechanically or electronically. The mechanical limiting mechanism may employ rigid, semi-rigid, or flexible shutters that obscure a portion of the photoreceptive element from incident light. The electronic mechanism may incorporate deactivation of a portion of the photoreceptive element or operation of the computer and signal processing circuitry to discard input from areas of the photoreceptive element that are outside of the active scanning area. Visual indication of the active scanning width may be provided, such as by a series of indicator lights, which can be selectively illuminated to indicate the currently active area.

In another aspect of the invention, the reading machine comprises a mass storage device that is preferably capable of both storing and retrieving information. It is also preferred that the device incorporate removable media such as magnetic or optical disks or flash card memory.

The invention further provides a method for converting written text to spoken, ordinary language that corresponds thereto. Generally stated the method, comprises the steps of: (a) presenting an image bearing said written text to a scanner, the scanner having a scanning area having a maximum width and an active width defined by a scanning width limiting mechanism adjustable to a preselected width at most equal to the maximum width, and the scanner comprising a photoreceptive element adapted to form an electronic representation of that portion of said image presented within the active width of the scanning area to the scanner; (b) scanning the image to form the electronic representation; (c) converting the electronic representation to a digital character string corresponding to the text comprised in the portion of the image; and (d) voicing the digital character string as ordinary spoken language through a sound-producing element.

It is an object of the invention to provide a reading machine capable of scanning and voicing arbitrary text, not merely text limited to a pre-determined repertoire of texts.

Another object of the invention is to provide a reading machine that may be operated as a portable, battery-operated, easily maneuvered, hand-held device and that allows the user to carry out the specific actions of positioning, aligning, and moving the scanner over textual material he/she desires to scan even for one having limited manual strength and dexterity.

A further object of the invention is to provide a reading machine that allows a user to visualize lines in a column of text proximate the line currently being scanned, to facilitate lateral alignment of the scanner.

Still another object of the invention is to provide a reading machine that positively assures that the scanner is oriented substantially at a pre-selected vertical angle with respect to the surface bearing the indicia to be scanned.

BRIEF DESCRIPTION OF THE DRAWINGS

The invention will be more fully understood and further advantages will become apparent when reference is had to the following detailed description of the preferred embodiments of the invention and the accompanying drawings, wherein like reference numerals denote similar elements throughout the several views, and in which.

DESCRIPTION OF THE PREFERRED EMBODIMENTS

The present invention is directed to a method and apparatus that enable users to easily scan a block or column of text and hear the text recited audibly via a voice module, or through a headset connection adapted for wired or wireless transmission. Scanned information can comprise multiple lines, selected segments of text such as columns or blocks, or substantially the entire textual content of a page. Scanned textual information may be processed by optical character recognition (hereinafter, "OCR") means to form an electronic representation of the text for further processing, voicing, storage, or transmission to an auxiliary personal computer (hereinafter, "PC") or a hand-held personal organizer (hereinafter, "PDA"). Retention of scanned text can comprise up to thirty pages or more. Links with a personal computer are optionally provided for upload or download of scanned information. Also contemplated are links permitting download of scanned information to a tape player. Attachments for hand-held organizers and messaging units, such as Palm or Visor, can be used to scan and transmit verbally any text stored therein or beamed thereto via wireless transmission. A see-through sleeve enshrouds the device to protect against damage from contaminants such as dust, oil, debris and the like. The screen may be transparent or segmented to permit review of portions of text other than those being scanned and transmitted verbally, or to permit note taking while listening to verbally read sections of text.

In one aspect the present invention comprises means for connecting the scanner unit to an external data processor such as a personal computer (PC), desktop computer, laptop computer, or personal digital assistant (PDA). The connection allows for information to be transferred, preferably bidirectionally, between the units. The connection may be made by any known means of interface. These means include wired interface connections such as the RS232 serial interface, the parallel interface, the universal serial bus (USB), Firewire (defined in the IEEE-1394 Standard provided by the Institute of Electrical and Electronics Engineers) interface Ethernet. Wireless means may also be used, comprising optical or radio transmission of data. One exemplary standard for such wireless communication is provided by the IEEE 802.11b Standard.

Figure 1:
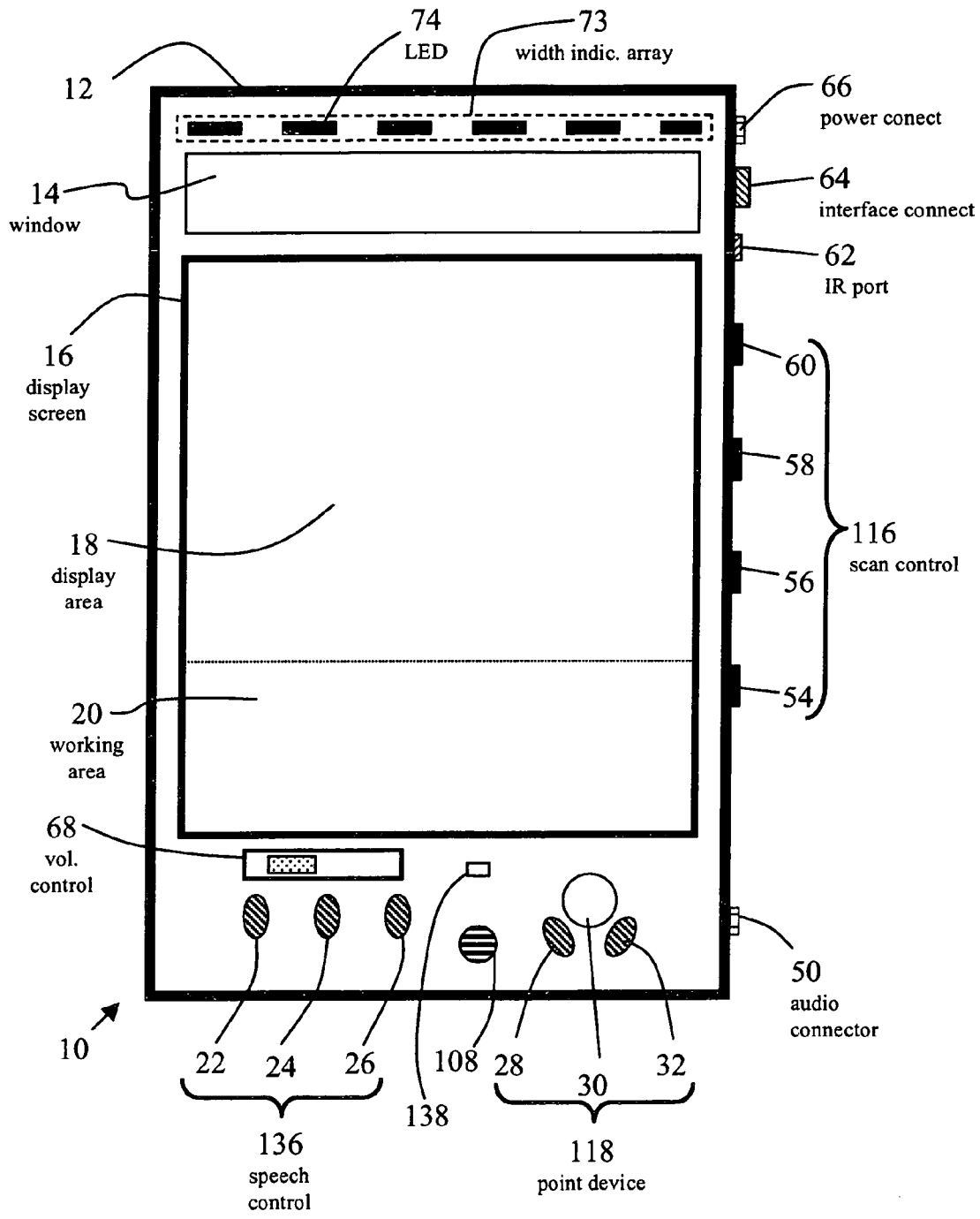
FIG. 1 is a top plan view of a reading machine of the invention.
Figure 2:
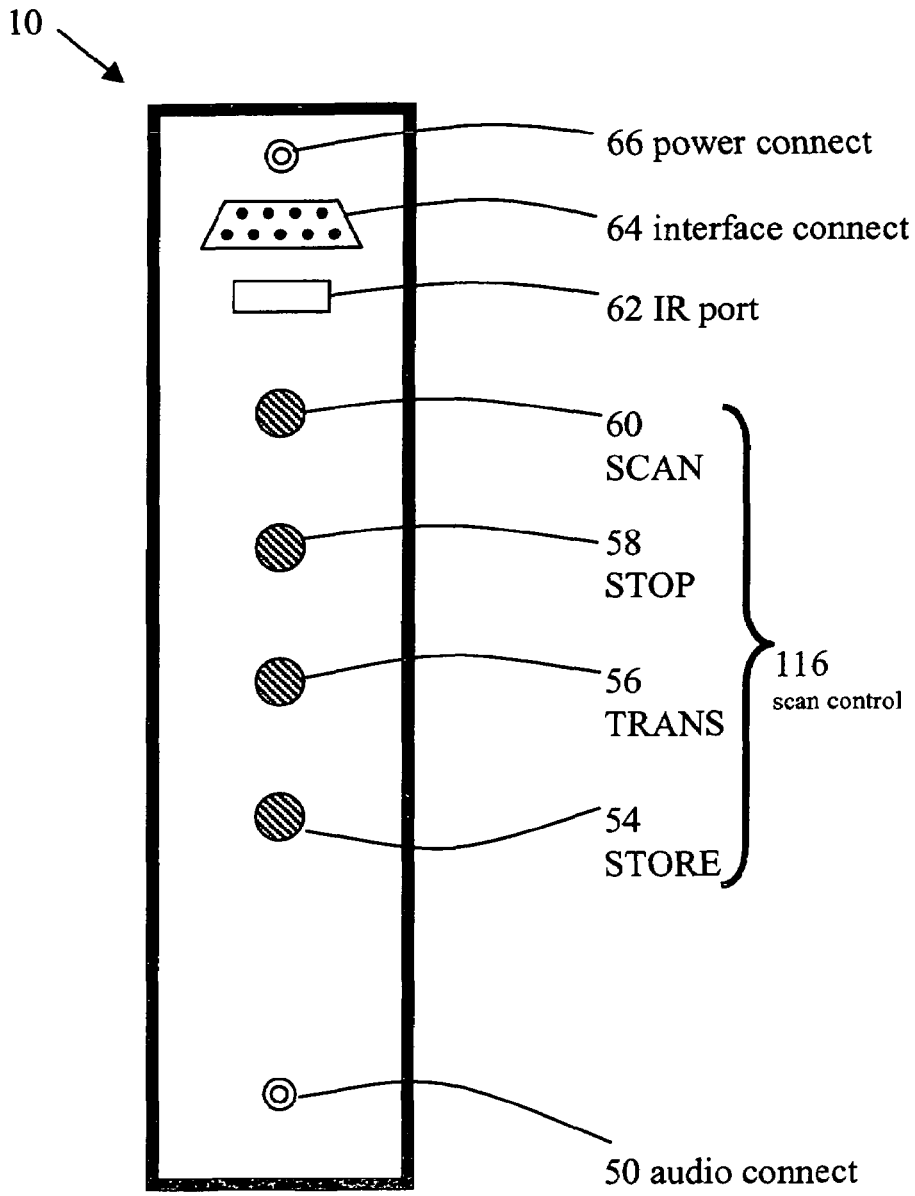
FIG. 2 is a side view of the reading machine depicted in FIG. 1.
Figure 3:
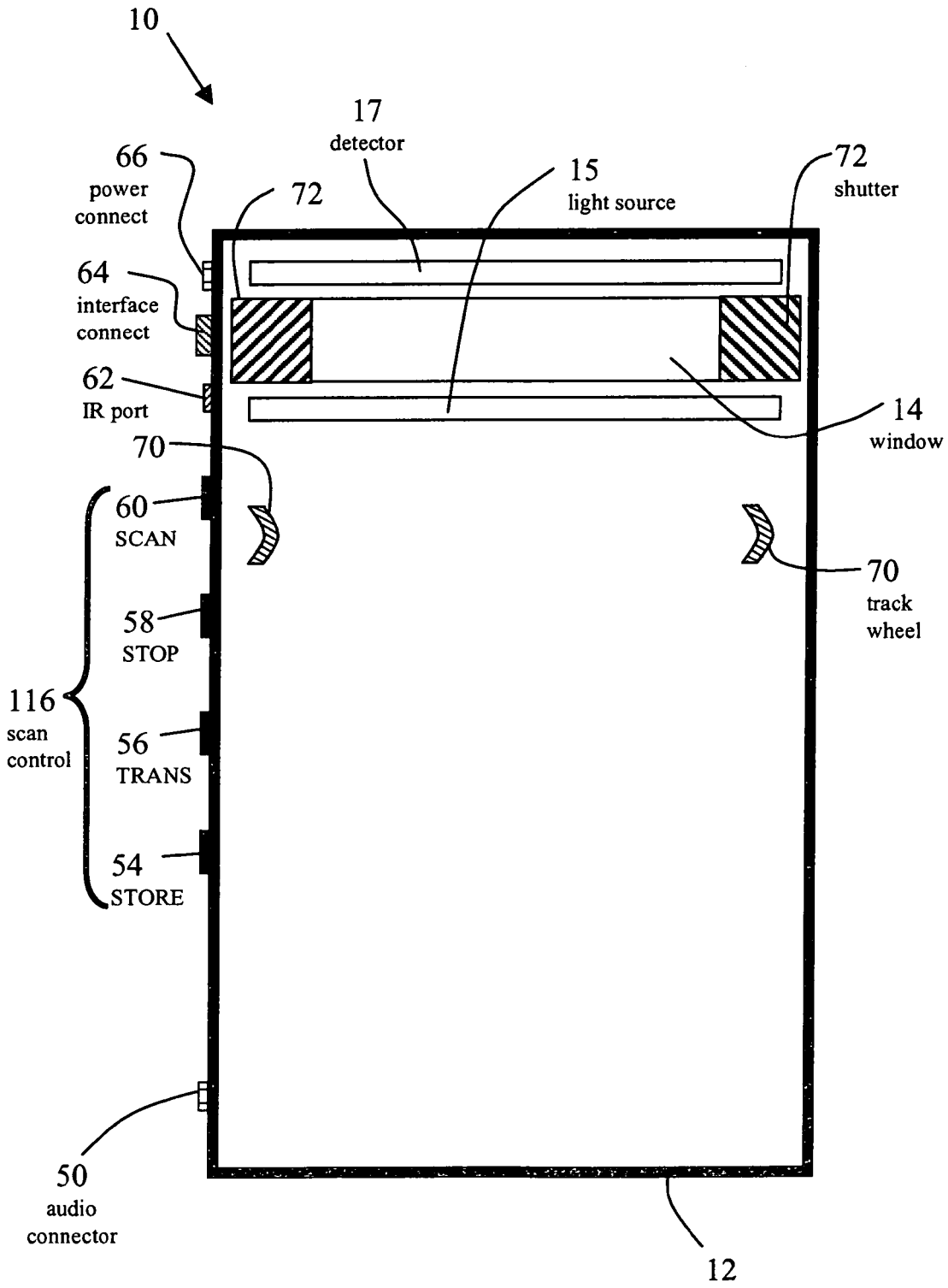
FIG. 3 is a bottom plan view of the reading machine depicted in FIGS. 1 and 2.

Referring to FIGS. 1, 2, and 3 there is shown generally at 10 one embodiment of the reading machine 10 of the invention. The unit is housed in a generally rectangular case 12. In use, the machine 10 is placed atop a page bearing indicia including written or printed text, of which at least a portion is preselected for scanning. The unit is aligned so that at least a portion of the preselected text is visible through transparent window 14 and is substantially horizontal with respect to window 14. Light source 15 (FIG. 3) illuminates the text. The unit may be protected by shrouding it with a transparent sleeve (not shown).

Figure 4:
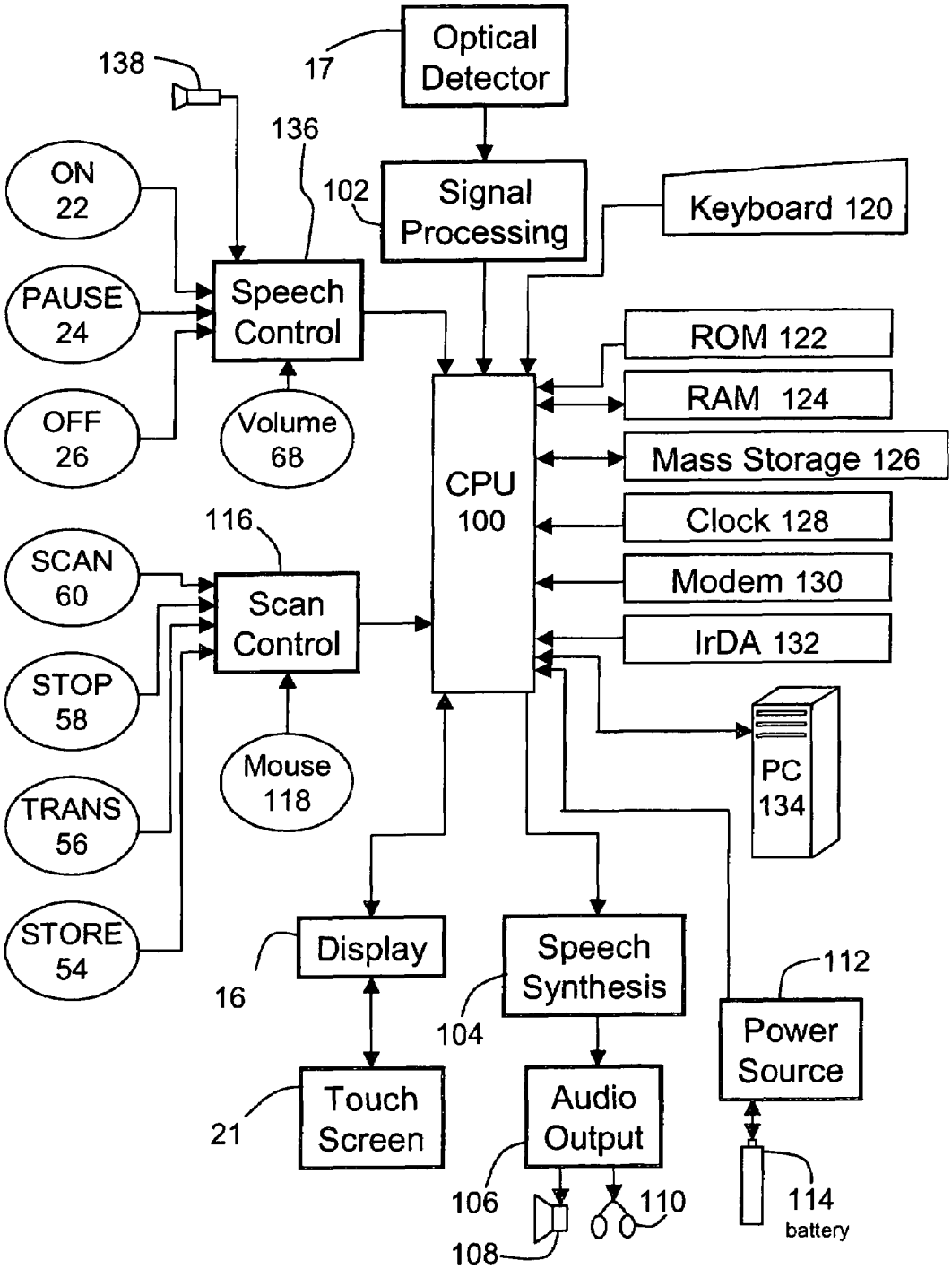
FIG. 4 is a block diagram of elements and their interconnection in the embodiment of the reading machine shown by FIGS. 1–3.

The user activates the scanning function by depressing SCAN button 60 and sliding the unit generally downwardly, traversing at least the preselected text. Scanning is terminated by depressing STOP button 58. At least one tracking wheel 70 rotatably mounted on the underside of case 12 is frictionally urged to rotate by the downward sliding of the unit. A rotational sensor (not shown) coupled to wheel 70 indicates the vertical position of detector 17 to processor 100 (FIG. 4).

The scanning function of the present apparatus relies on variations of the reflectivity of the scanned page. The pattern of this reflectivity conveys the typographic features that define the alphanumeric characters present in text on the page. Photoreceptive element 17 is an optical detector which senses light reflected from the substrate on which text or other graphic information is present. The maximum width of the scanning area that can be scanned by reading machine 10 is determined by the maximum width over which photoreceptive element 17 is responsive. Preferably photoreceptive element 17 senses reflected light along a line extending substantially across the full width of transparent area 14.

Any form of device whose electrical characteristics change in response to the incidence of light may be used to construct photoreceptive element 17. Representative of these devices are photocells, photoresistors, photodiodes, and phototransistors. Preferably, a charge-coupled device (CCD) is used. Photoreceptive element 17 preferably comprises one or more devices that allow the intensity of incident light to be separately recognized in each of a linear array of pixels distributed along a line extending transversely across the bottom surface of case 12 of reading machine 10 and proximate transparent area 14. Photoreceptive element 17 may incorporate either discrete devices for each pixel or, more preferably, an integrated device such as a CCD having a plurality of closely spaced but separately addressable detecting elements incorporated on a single substrate by techniques known for integrated circuit manufacture. Acquiring intensity data along a series of such transverse lines closely spaced in the perpendicular, longitudinal direction allows an image to be defined by discrete pixels in a rectangular array that substantially correspond to a rectangular area in a raster-like fashion. The positioning in the longitudinal direction of each transverse scan line may be derived from the rotational sensor coupled to tracking wheel 70 (FIG. 3).

The resolution and fidelity of the scanner and the accuracy of its text conversion are enhanced by use of a detector having a high linear density of pixels and the acquisition of data along scan lines that are closely spaced in the longitudinal direction. Resolution is conventionally specified in dots per inch (dpi). A detector having at least about 100 pixels per inch in the transverse direction is preferred, as is acquisition of the image along scan lines at a longitudinal density of at least about one hundred lines per inch. More preferably, an image having at least about 300 dpi resolution in both directions is preferred. It is preferred that this fidelity be attained by use of a high resolution CCD detector.

Text characters and graphic content comprised in a scanned page are thus manifested in the particular pattern of reflectivity imaged through the functioning of photoreceptive element 17. The acquisition of signal by photoreceptive element 17 may be triggered in response to commands from processor 100 (FIG. 4).

The scanning is active over an area whose width is adjustable as will be discussed in further detail hereafter. FIG. 2 depicts one means by which the adjustment may be accomplished, i.e., horizontally movable, substantially opaque shutters 72 that define the lateral extent of the area to be scanned, i.e., the active scanning width.

Referring now to FIG. 4 the output of photoreceptive element 17 furnishes electrical signals to signal processing circuit 102 which operates in concert with processor 100 to produce a digitized, electronic representation of the scanned area comprising desired text and/or graphic images. Signal processing circuit 102 comprises amplification, filtering, and analog to digital conversion circuit elements known in the art. The digitized, electronic representation is preferably an array, each element thereof representing digitally the intensity in a corresponding pixel, the totality of the pixels substantially covering the desired two-dimensional area of the scanned image.

OCR software present in processor 100 operates to convert the digitized, electronic image representation to a digital character string corresponding to the text. Either of the electronic image representation or the digital character string may be stored, further processed, or transferred to a separate computer. OCR software techniques suitable for use in the present system are known in the art.

After text in the scanned image is acquired and processed to form a digital character string, the text is presented on display screen 16 in display area 18. The screen may optionally be subdivided to provide a working area 20 in addition to display area 18. The division is preferably effected by software, but two separate display screens might also be used for display area 18 and working area 20 if desired. Display screen 16 may be of any type known in the computer art, such as LCD, LED, electro luminescent, or plasma displays. The display may be monochromatic or in color.

The speech synthesis function 104 of the reading machine 10 is activated and controlled by speech control function 136 including user buttons 22,24,26. "ON" button 22 activates the voicing of speech, "PAUSE" button 24 suspends voicing, and "OFF" button 26 terminates a session. Speech synthesis circuitry 104 and audio output circuitry 106 operate in concert with processor 100 to produce an analog voltage suitable for driving speaker 108 or headset 110 connected at connector 50. The output volume is adjustable by slidable volume control 68. Alternatively, the reader may transmit audio through a wireless radio or infrared connection to a free headset.

In another aspect of the invention the speech synthesis function 104 may is also controlled by voice activation. Microphone 138 is appointed to accept spoken commands and convert the speech to electrical impulses that are fed to speech control 136. The function of microphone 138 is also carried out by speaker 108 using means and circuitry known in the art. Operating in concert with processor 100, speech control 136 uses voice recognition software to receive and process a repertoire of commands. Preferably the repertoire includes at least "ON," "OFF," and "PAUSE." The setup of the system comprises a training function by which processor 100 acquires a speech pattern characteristic of a user's pattern for uttering the commands to be processed. On receipt of these spoken commands during the subsequent use of the reading machine, the same functions are activated as if corresponding buttons 22, 24, 26, respectively, had been pressed. More preferably, the repertoire includes additional commands that activate additional functions, such as "REPEAT." A variety of such commands will suggest themselves to those skilled in the art.

In FIG. 4 there is shown a block diagram containing elements of one aspect of the present reading machine 10. The elements shown correspond to the hardware depicted by FIGS. 1–3. Power source 112, preferably comprising batteries 114 that are removable and rechargeable, provides power for reading machine 10. Power may also be provided to operate the unit and/or recharge batteries 114 by connection through connector 66 to a power converter of conventional design (not shown) energized by a source of household current. Alternatively power source 112 may comprise replaceable batteries or solar cells. A further alternative is for power to be derived for operation or battery charging from the bus of external computer 134 to which reading machine 10 may be connected.

As discussed above, the digital character string representation of the text may be used further in several ways. Preferably, the representation is converted by speech synthesis system 104 into an electrical signal, which is fed to an audio output circuit 106 including a sound-producing element such as speaker 108, wired headset 110, or wireless headset (not shown). Speaker 108 is preferably mounted to project sound through the top face of case 12. Voltage provided by circuit 106 drives the sound-producing element to output intelligible, voiced ordinary spoken language corresponding to the text. In a further aspect of the invention processor 100 may be afforded with language translation software means so that printed text in an original ordinary language may be scanned, converted to a digital character string representation in the original language, translated to form a digital character string representation in a second ordinary language, and voiced as speech in that second language.

As used herein, alphanumeric text comprises the characters required in ordinary written language typically including at least the upper and lower case letters of the Roman alphabet, each of the numerals, and punctuation marks. Preferably, alphanumeric text further comprises other common typographical marks, including simple shapes, currency symbols, and the like. Alphanumeric text is very frequently processed and stored in computer memory and storage media using the ASCII standard for coding text characters into a binary representation thereof.

As would be appreciated by one of ordinary skill, the present system could readily be modified to recognize and process text of languages that use an alphabet with accents and similar diacritical marks not required in English. The system could also be modified to be suitable for text having non-Roman alphabets or having pictographic characters such as are used in many Asian languages by incorporation of suitable image-processing software.

In addition to the voicing or speech function of the reading machine system, additional text and graphic processing capabilities may be afforded and activated by scan controls 116. After text is acquired, as controlled by SCAN button 60 and STOP button 58, further manipulation may be accomplished by transfer button TRANS 56 and STORE button 54. Text may be selected for transfer to storage or an auxiliary computer using pointing device 118. Various pointing devices familiar to users of personal computers, including computer mouse devices, track balls, touch sticks, and the like may be employed. FIG. 1 depicts one such pointing device 118 comprising a trackball 30 and selection buttons 28, 32. Pointing device 118 is operated in a manner conventional in the personal computer art for highlighting text. The position of a cursor in display 18 is correlated with the position of trackball 30. Trackball 30 is first moved to position the cursor over the desired beginning of the text to be highlighted. Button 28 is depressed while trackball 30 is moved to position the cursor at the end of the text to be highlighted and is then released. Pressing TRANS button 56 causes the highlighted text to be moved to area 20 of screen 16. Text may be stored in mass storage device 126 by pressing STORE button 54. Of course, reading machine 10 may also be equipped with other known forms of computer mice and similar pointing devices. Text selection and other control functions may also be implemented by including optional touch screen functionality 21 in display 16 of reading machine 10.

Many additional text selection, processing, and storage functions familiar in the data processing art can be implemented by suitable software programming of processor 100.

The various user controls and pointing device may be used for user selection of these functions. Further, the unit may also serve the optional functions of acquiring, storing, and transmitting graphic images.

The reading machine 10 of the invention and its processor 100 may communicate bidirectionally with a separate, external computer, such as a conventional personal computer (PC) 134 or a PDA (not shown). A number of PDA's are commercially available, including the Palm Pilot of Palm Computing, the Jornada of Hewlett Packard, the Clie of Sony, and the iPAQ of Compaq, the Word Pad of IBM, and may be connected and used in connection with the present machine and system. Advantageously, connection to either type of device allows text and graphic images acquired by the reading machine 10 to be transferred to the external computer for subsequent use. In addition, text and graphics images may be transferred from the external computer to the reading machine for display or voicing. For example, a set of verbal instructions for navigating a car to a desired destination might be downloaded to the reading machine. The driver could use the speech controls to cause each item of the directions to be voiced at an appropriate point in the course of the journey. The driver would thus be able to obtain helpful directions without being distracted by the need to consult a map or other written material. Driving safety and convenience would thus be enhanced.

The external computer may be connected via a cable at connector 64 which, in turn, is associated with processor 100. A conventional D-type connector 64, such as that used in the well-known RS-232 communications protocol, is shown. Other forms of wired interface and protocol for the transmission and reception of digital information may also be used. Representative thereof are the Universal Serial Bus (USB), or the Centronics (parallel) interface, which require other forms of connector as would be recognized by one skilled in the computer interfacing art. Alternatively, the bi-directional communication may be accomplished wirelessly. Infrared (IR) transmitting/receiving port 62, conforming to the known IrDA standard, may be used to link the processor 100 of reading machine 10 to an external computer through IrDA interface 132. Reading machine 10 may also comprise provision (not shown) for wireless communication to be effected via radio, such as with a local area network (LAN) operated in accordance with IEEE Standard 802.11b. Furthermore, reading machine 10 may be equipped with a modem 130 for communications with a remote system by telephone or cable or via a wireless cellular telephone connection. Any of the above interfaces may also be used to connect the reading machine to other data processing equipment including printers and external mass storage devices.

Other functions conventionally required for the operation of digital microprocessor 100 may also be provided, including a clock 128, read-only memory (ROM) 122, and random access memory (RAM) 124. A keyboard 120 is also optionally provided for ease of entry of data. Reading machine 10 preferably comprises at least one form of readable mass storage device 126, such as solid-state memory or magnetic, magneto-optical, or optical disk drives. More preferably, mass storage device 126 includes capability for both reading and writing. Most preferably, mass storage device 126 comprises a removable, read/write storage medium such as a removable disk or flash card memory. Use of removable, writable media advantageously allows scanned material to be retained or transferred to another computer or device for subsequent use.

The present reading machine advantageously comprises means for adjustment of the active scan width, i.e., the width over which optical detection and processing of the material inputted is carried out. This adjustability allows scanning to be limited to an area whose width corresponds substantially to the width of the selected textual material. This feature is especially useful for scanning items whose text is organized in columnar fashion, such as a newspaper. Some known scanning systems require that the material first be prescanned with subsequent user intervention to identify column boundaries or to designate the material that is in fact desired. In either case, extra steps are required, making the prior art systems less convenient to use. The simple width selection afforded by the present system beneficially enhances speed and ease of use, since text extraneous to the user's interest is not scanned initially, nor must it be removed by subsequent user intervention or functioning of software. Systems lacking initial width limitation thus are more inconvenient and more time consuming to use, because of the added steps required. By way of contrast, the ease of use and convenience of the present system beneficially renders it portable and usable in circumstances wherein previous systems are not feasibly employed.

Moreover, known scanning systems that rely on software-based methods to infer column boundaries contextually are quite prone to error. Inevitably, intrusion of characters from unwanted columns disrupts the desired text. Moreover, considerable time and processor power is required for the OCR software to analyze the input image and thereby parse the column formatting presented, even with fast processors and extensive memory space. The present system is far simpler and cheaper to implement and operate with currently available processor circuits and methods. Few if any extraneous characters need to be identified and subsequently disregarded, since they are excluded from the scanned image from the beginning by operation of the scanned width limitation mechanism.

In the aspect of the invention shown in FIG. 3, the adjustment of scan width is accomplished mechanically by movable, substantially opaque, horizontal shutters 72. Shutters made of rigid or semi-rigid materials including metal or plastic may be provided either on one side or both sides of window 14 and may be slidably mounted in a track incorporated in case 12. In another alternative form (not shown), shutters 72 may be made of flexible opaque material and coiled for storage on a shaft located in a recess in the underside of case 12 adjacent either or both sides of window 14. The coil may be spring-loaded and permit the shutter to be retractably and reversibly withdrawn from the shaft to obscure a peripheral portion of transparent window 14 and limit the active scanning width to a preselected width.

In another preferred aspect of the invention the image width adjustment is accomplished electronically. The adjustment is effected in different ways depending on the particular form of photoreceptive element used. Some such elements comprise a plurality of discrete detectors, whose outputs are separately connected to signal processing circuit 102. Those detectors lying outside the desired scan region may either be deactivated or their outputs disregarded before processing. In other cases, especially with CCD optical detectors, the photo detection and processing functions may be integrated into a single solid-state device whose output is in digital form with the light intensity at each pixel separately addressable. In this case, information from pixels outside the scan region of interest may be immediately disregarded by the operation of processor 100. It is preferred that electronic adjustment of scan width in this aspect be carried using pointing device 118 in a conventional manner comprising correlated activation of buttons 28, 32 and movable element 30, as is familiar to users of current graphically based PC software like Microsoft Windows™.

The operability of the reading machine is enhanced by a direct visual indication of the currently active scan width. In the case of mechanical shutters as depicted by FIG. 3, the position of the shutters and the resulting active scanning width is immediately apparent upon inspection of the unobseured portion of window area 14 as visualized either from the top or bottom of case 12. The embodiment depicted by FIG. 1 provides a preferred alternative width indicator comprising a series of indicator lights, such as a linear array 73 of LED's 74 deployed substantially across the width of window area 14. This method of width indication is especially suited for use in conjunction with the electronic scan width adjustment discussed above. In operation, segments corresponding to the currently selected scanning width may be illuminated to serve as a visually apparent width indicator, while segments corresponding to areas outside the active scan width are not illuminated.

Figure 5:
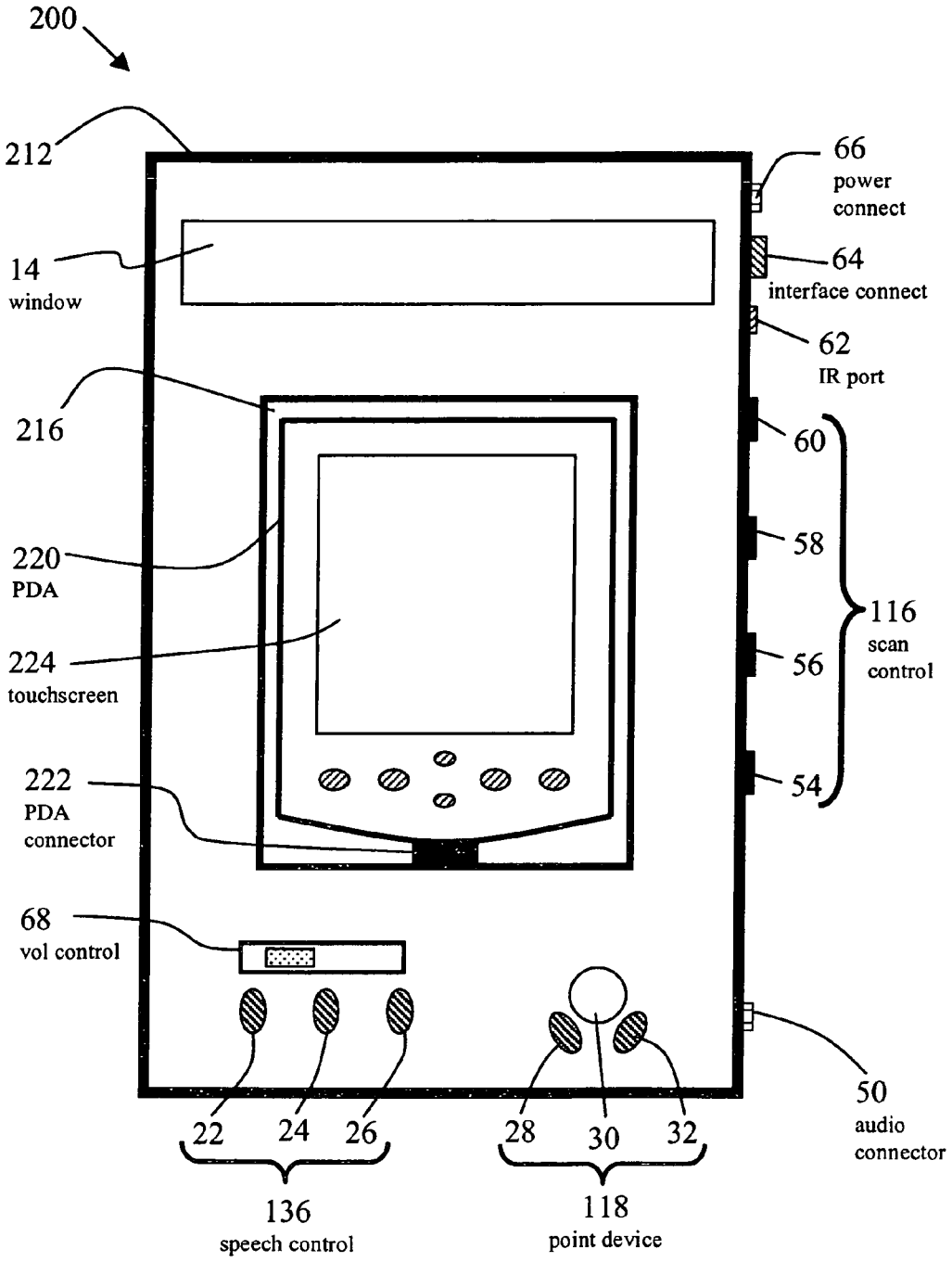
FIG. 5 is a top plan view of a reading machine system comprising a personal organizer.
Figure 6:
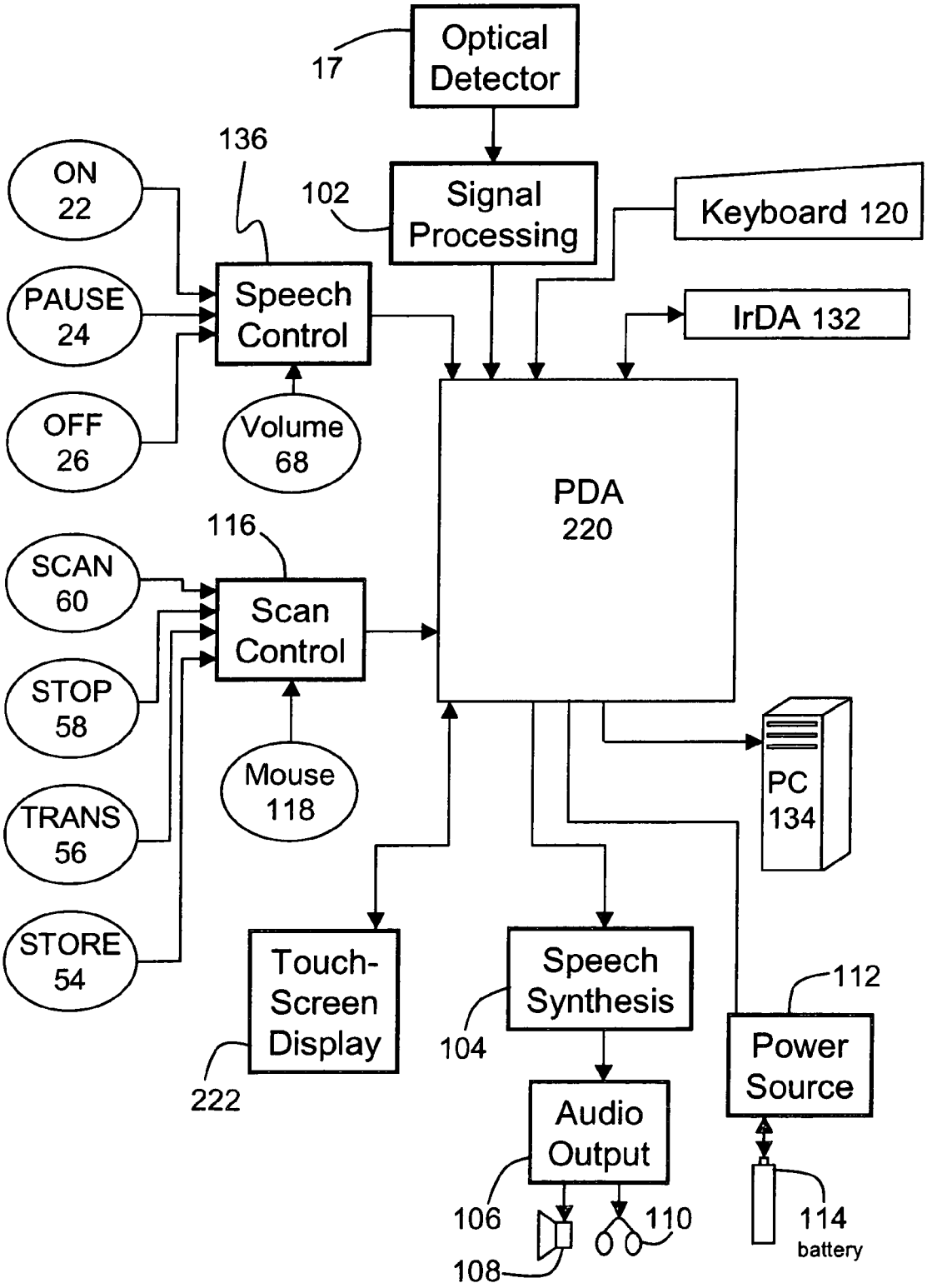
FIG. 6 is a block diagram of the elements and element interconnection for the reading machine system of FIG. 5.

In yet another aspect of the invention depicted by FIG. 5, reading machine system 200 incorporates optical scanning and speech synthesis functions working cooperatively with a PDA 220 or similar device. The system employs the processor and ancillary hardware of PDA 220 in lieu of internal circuitry to carry out at least a portion of the appointed scanning and speech synthesis functions of system 200. Preferably reading machine system 200 is housed in a case 212 having an inset 216 on the topside thereof that accommodates and secures PDA 220 removably. Connector 222 is situated in inset 216 for connection of the bus of PDA 220 to other functions and circuitry of reading machine system 200. When not being used with system 200, PDA 220 may be removed and used for any of its customary built-in functions. Reading machine system 200 may incorporate any of the operating controls present in the embodiment depicted by FIGS. 1, 2, and 3. Alternatively the functions associated with these controls may be activated by command operations initiated with the controls and inputs of PDA 220 including touch screen 224 and issued via the PDA bus. A block diagram of one form of such a reading machine system 200 is depicted by FIG. 6. A number of the ancillary functions incorporated in the embodiment of FIG. 4, e.g. ROM, RAM, mass storage, and clock are frequently included and operative in a PDA, and so are not shown in FIG. 6. Nonetheless, any of the functions may optionally be incorporated in system 200 separate from removable PDA 220.

Having thus described the invention in rather full detail, it will be understood that such detail need not be strictly adhered to but that various changes and modifications may suggest themselves to one skilled in the art, all falling within the scope of the present invention as defined by the subjoined claims.

What is claimed is:

1. A reading machine, comprising:

a. a scanner for scanning an image comprising text, said scanner having a scanning area occupying a maximum width and an active width defined by a scanning width limiting mechanism user-adjustable to a preselected horizontal width at most equal to said maximum width, said scanner comprising a photoreceptive element adapted to form an electronic representation of that portion of said image presented within said active width of said scanning area to said scanner;

b. a converter connected to said scanner and adapted to receive said electronic representation from said scanner, and to convert said electronic representation to a digital character string corresponding to the text comprised in said portion of said image; and c. a speech system for outputting said digital character string as ordinary spoken language voiced through a sound-producing element.

2. The reading machine of claim 1, further comprising a microprocessor for controlling said reading machine.

3. The reading machine of claim 1, wherein said image width selection mechanism comprises at least one horizontally movable, substantially opaque shutter.

4. The reading machine of claim 1, wherein said photoreceptive element comprises a plurality of detector devices that allow the intensity of light incident thereon to be separately recognized in each of a plurality of pixels, said pixels being distributed across the width of a line extending transversely across said scanning area.

5. The reading machine of claim 4, wherein said photoreceptive element comprises a charge-coupled device array.

6. The reading machine of claim 4, further comprising a width indicator that provides visual indication of said active width.

7. The reading machine of claim 6, wherein said width indicator comprises an array of indicator lights selectively operable to indicate said active width.

8. The reading machine of claim 1, further comprising a transparent window area that allows visualization of text proximate text currently being scanned.

9. The reading machine of claim 1, further comprising a mass storage device.

10. The reading machine of claim 9, wherein said mass storage device comprises removable media.

11. The reading machine of claim 9, wherein said mass storage device comprises flash card memory.

12. The reading machine of claim 1, further comprising a translating system whereby text scanned in an original ordinary language is translated into a second ordinary language and said speech system voices said text in said second ordinary language.

13. The reading machine of claim 1, further comprising an interface communication protocol system adapted for connecting said reading machine to an external data processing device, said interface communication protocol system being selected from the group consisting of cable, wireless radio, and infrared communications.

14. The reading machine of claim 1, further comprising voice activated control of said speech system.

15. A reading machine system having a reading machine, comprising:

a. scanning means for scanning an image comprising text, and having a scanning area occupying a maximum width and an active width defined by a scanning width limiting mechanism user-adjustable to a preselected horizontal width, said scanning means comprising a photoreceptive element adapted to form and present to said scanning means an electronic representation of a portion of said image within said active width;

b. converter means connected to said scanner and adapted to receive said electronic representation from said scanner, and to convert said electronic representation to a digital character string corresponding to the text comprised in said portion of said image; and c. speech system means for outputting said digital character string as ordinary spoken language voiced through a sound-producing element;

said reading machine being adapted to be removably connected to a personal organizer system.

16. A method for converting written text to spoken, ordinary language, corresponding thereto, comprising the steps of:

a. presenting an image bearing said written text to a scanner, said scanner having a scanning area occupying a maximum width and an active width defined by a scanning width limiting mechanism user-adjustable to a preselected horizontal width, and comprising a photoreceptive element adapted to form and present to said scanner an electronic representation of that portion of said image presented within said active width of said scanning area;

b. scanning said image to form said electronic representation;

c. converting said electronic representation to a digital character string corresponding to the text comprised in said portion of said image; and d. voicing said digital character string as ordinary spoken language through a sound-producing element.

17. The method of claim 16, further comprising the step of controlling said voicing by a voice activation.

* * * * *